US008393710B2

(12) United States Patent
Conta et al.

(10) Patent No.: US 8,393,710 B2
(45) Date of Patent: Mar. 12, 2013

(54) PARALLEL INK JET PRINTING DEVICE AND RELATIVE MANUFACTURING

(75) Inventors: Renato Conta, Ivrea (IT); Enrico Manini, Chiaverano (IT)

(73) Assignee: Telecom Italia S.p.A., Milan (IT)

( * ) Notice: Subject to any disclaimer, the term of this patent is extended or adjusted under 35 U.S.C. 154(b) by 0 days.

(21) Appl. No.: 13/182,551

(22) Filed: Jul. 14, 2011

(65) Prior Publication Data

US 2011/0267402 A1 Nov. 3, 2011

Related U.S. Application Data

(63) Continuation of application No. 10/530,407, filed as application No. PCT/IT03/00607 on Oct. 8, 2003, now Pat. No. 7,984,978.

(30) Foreign Application Priority Data

Oct. 10, 2002 (IT) ..... TO2002A0876

(51) Int. Cl.
*B41J 23/00* (2006.01)
*B41J 29/393* (2006.01)
*B41J 2/175* (2006.01)

(52) U.S. Cl. ..... 347/39; 347/19; 347/85

(58) Field of Classification Search ..... 347/85, 347/39, 19

See application file for complete search history.

(56) References Cited

U.S. PATENT DOCUMENTS

| | | | | |
|---|---|---|---|---|
| 5,160,945 | A | 11/1992 | Drake | |
| 5,896,146 | A | 4/1999 | Murata et al. | |
| 6,039,441 | A | 3/2000 | Tomikawa et al. | |
| 6,068,367 | A * | 5/2000 | Fabbri | 347/49 |
| 6,089,693 | A * | 7/2000 | Drake et al. | 347/19 |
| 6,137,506 | A | 10/2000 | Sueoka | |
| 6,142,604 | A * | 11/2000 | Kanda et al. | 347/41 |
| 6,155,669 | A | 12/2000 | Donahue et al. | |
| 6,439,908 | B1 | 8/2002 | Silverbrook et al. | |
| 6,557,976 | B2 | 5/2003 | McElfresh et al. | |
| 2002/0008731 | A1 | 1/2002 | Matsumoto et al. | |

FOREIGN PATENT DOCUMENTS

| | | |
|---|---|---|
| EP | 0 666 174 A2 | 8/1995 |
| EP | 0 677 387 A2 | 10/1995 |
| EP | 0 816 085 A2 | 1/1998 |
| IT | TO-1 234 800 | 5/1992 |
| IT | TO-2001A000707 | 7/2001 |
| IT | TO-2001A001019 | 10/2001 |
| IT | TO-2002A000144 | 2/2002 |

* cited by examiner

*Primary Examiner* — Stephen Meier
*Assistant Examiner* — Sarah Al Hashimi
(74) *Attorney, Agent, or Firm* — Venable LLP; Steven J. Schwarz; Robert Kinberg

(57) ABSTRACT

The printing device is ink jet, parallel or serial-parallel type and comprises a plurality of ejection modules each of which with ejection chambers suitable for containing ink and with associated relative heating elements for ink ejection control. The device includes a support and a nozzle plate common to the modules, and in which the support includes a base plate of rigid material that defines through its thickness a feeding duct for the ink which, in use, is substantially parallel to the line of printing (X axis) and the ejection modules are fixed side by side on the base plate and with the ejection chambers arranged in a line in the same direction (X axis), is a hydraulic, tight connection with the feeding duct. The nozzle plate is fixed on the ejection modules constituting an upper, hydraulically tight, closing surface, for the chambers and comprises a plurality of ejection nozzles in a line, in turn in hydraulic connection with corresponding cells of the modules.

11 Claims, 6 Drawing Sheets

PARALLEL INK JET PRINTING DEVICE AND RELATIVE MANUFACTURING

This application is a divisional of co-pending U.S. patent application Ser. No. 10/530,407 filed Oct. 2, 2006, which is a National Stage application of International Patent Application No. PCT/IT2003/000607 filed Oct. 8, 2003, which claims the benefit of Italian Application No. TO2002A00876 filed Oct. 10, 2002. The subject matter of the foregoing applications is expressly incorporated by reference herein in their entirety.

TECHNICAL FIELD

This invention relates to parallel type, ink jet printing devices. More specifically, the invention relates to an ink jet printing device with a parallel type or serial-parallel type head comprising a plurality of ejection modules in accordance with the introductory part of claim 1.

The invention has been developed with particular regard for application on a device in which heat energy is used to produce vapour bubbles in chambers filled with ink, resulting in the ejection of droplets of ink through relative nozzles.

BACKGROUND ART

Thermal type ink jet printing devices use heads having ejection modules which are usually made from wafers of semiconducting material with technologies similar to those employed for producing integrated and/or hybrid circuits. This means that the heating elements and relative driving circuits, together with the hydraulic, ink feeding network, can be obtained, all within extremely reduced dimensions.

This is a solution used widely to produce printheads borne by carriages which, in use, are made move transversally over the surface to be printed, all of this according to a typical, serial type printing method.

The ink jet technology is also suitable for the production of printing devices having parallel or serial-parallel type heads with printing of the entire line of a page in a single run, that is without any scanning movement of the head over the surface being printed on or with a movement that is restricted to a fraction of the line.

Solutions are known that simplify the manufacture of heads for serial printing. For example, in Italian patent application No. TO2002A000144 filed on Feb. 20, 2002 by the Applicant, ejection modules are used with resistors adjacent to an edge of greater length and terminals arranged on the opposite edge, and in which nozzles are produced on a plate fixed and hydraulically tight on the module. Advantageously, feeding for the ink of the different chambers takes place through a slot in the support, common to all the chambers and which extends parallel to the nozzles.

The printing devices with heads that operate in parallel or serial-parallel are of compact dimensions and enable printers of great simplicity and limited encumbrance height-wise to be produced. Their field of application thus extends to sectors which include, inter alia, the printing of cash slips, labelling, printing in measuring equipment and photographic printing, as described for example in patent application No. TO2001A000707, filed on 19 Jul. 2001 by the Applicant.

The manufacture of ink jet printing devices having parallel or serial-parallel heads conflicts however with the difficulty of making, with a yield sufficient to allow components to be obtained economically, chips of considerable length (>1 inch) that have zero defects. Furthermore, there is also the risk, at the conclusion of the manufacturing process, of ending up with a faulty device for the sole fact that, in a head, one only of the numerous nozzles and/or heating elements is not functioning. The scale of these problems has been such as to render the production of these devices economically very unattractive up till now.

To overcome the technological and production difficulties of the parallel or serial-parallel printing devices, one proposal has been the recourse to heads with numerous elementary ejection modules of compact dimensions, assembled in such a way as to give a disposition of nozzles aligned in a common direction as in a single module, of the same length as the printing width.

The modules are stuck side by side, with pitch between the nozzles being maintained constant. This also applies to the last nozzle and the first nozzle of two adjacent units. However, other problems arise from using this structure such as, for instance, that of the impossibility of using modules in which feeding of the ink occurs through common slots.

Also proposed have been ink jet devices with heads operating in parallel, having ejection modules and nozzles in a staggered arrangement. This, however, gives rise to a worsening of the alignment of the dots in the printing phase and a more complex logic for controlling activation of the nozzles and in the associated circuitry.

DISCLOSURE OF THE INVENTION

The main object of this invention consists in producing ink jet printing devices having parallel or serial-parallel type heads, without the drawbacks mentioned above and which can be made with low production times and costs.

Another object of the invention is that of defining a process for the production of ink jet printing devices with parallel or serial-parallel type heads, in which there is feeding of the ink into the ejection chambers through common ducts or slots, produced on a low-cost support and with little precision, which do not interfere with the integrity and robustness of the ejection modules and associated functional components.

Yet another object of the invention is that of providing an ink jet printing device with nozzles arranged in a line in a direction parallel to the printing axis, of low dimensions and cost and which guarantees a good printing resolution.

A further object of the invention is to produce a colour ink jet printing device, with parallel or serial-parallel heads of compact dimensions and at low cost. These objects are achieved by the parallel or serial-parallel printing device of the invention according to the characteristic parts of the main claims.

The characteristics of the invention shall become clear from the description that follows, provided by way of non-restrictive example, with reference to the accompanying drawings, in which.

DESCRIPTION OF THE INVENTION

As regards the technology selected to produce the modules of the heads, the invention relies on known techniques. The relative details will not therefore be discussed comprehensively also because they are of no importance, in themselves, for the purpose of understanding of the invention. Against this backdrop, the representations of the drawings have been schematized, and illustration of the elements of the invention has been given priority over those of details that are already known.

Figure 1:
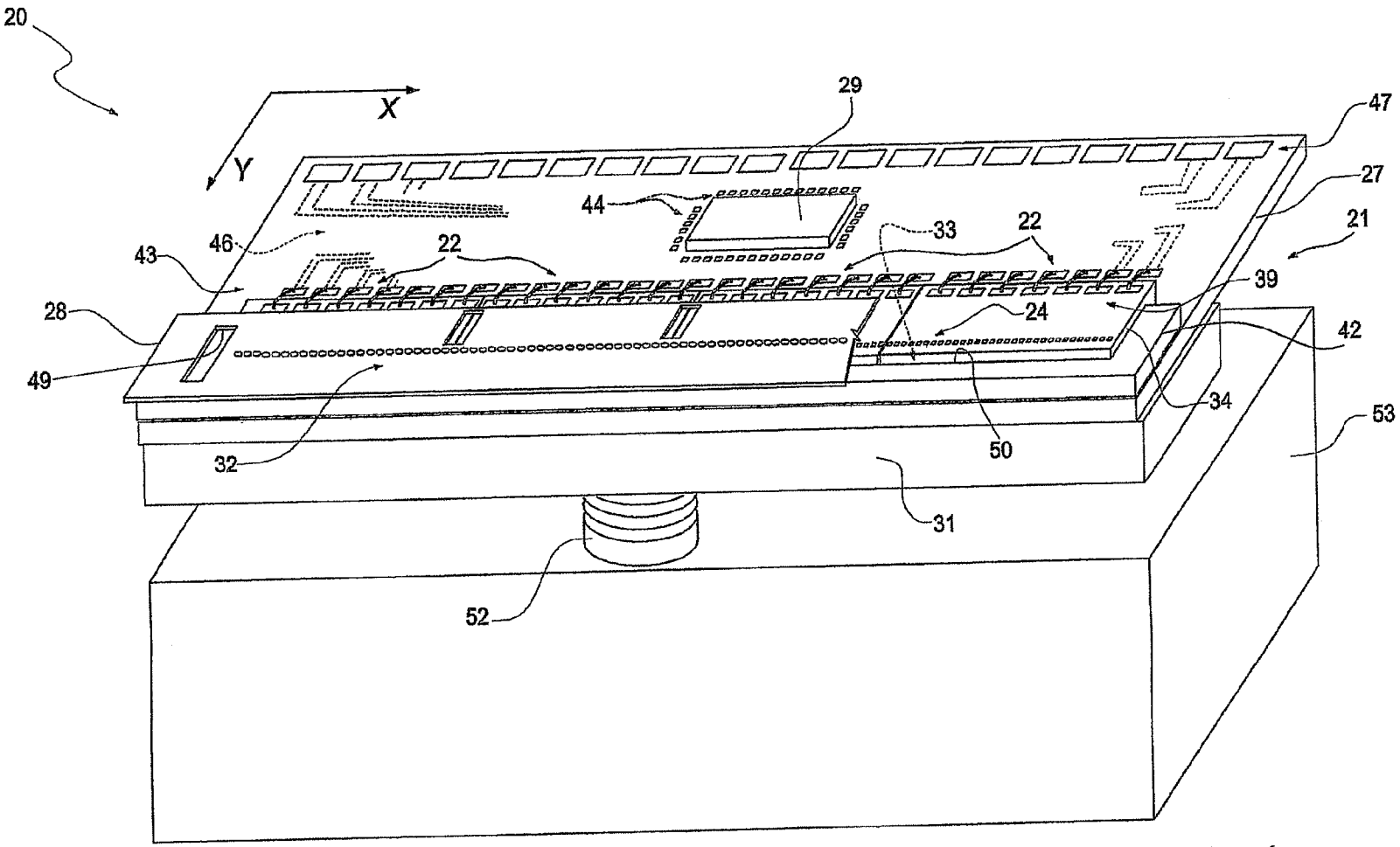
FIG. 1 is a schematic view of an ink jet printing device having a head operating in parallel or serial-parallel, according to the invention.
Figure 2:
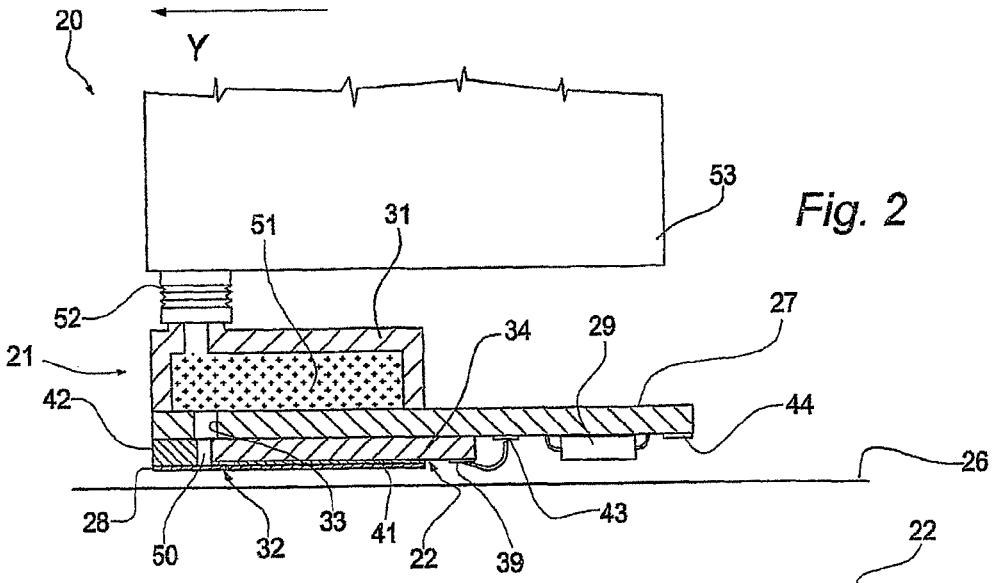
FIG. 2 shows schematical view of the device of FIG. 1.

Depicted in FIG. 1, and designated with the numeral 20, in an upside-down position, is an ink jet printing device according to the invention for a printer not shown in any of the figures, with reference to an axis "X" parallel to the line of print and to an axis "Y" in the direction of feeding of the print medium.

The device 20 employs a head 21 of the serial-parallel type having a row of nozzles which extends in a main direction parallel to the line of printing of a page and in which the nozzles eject droplets of ink on an elementary line of printing.

Figure 3:
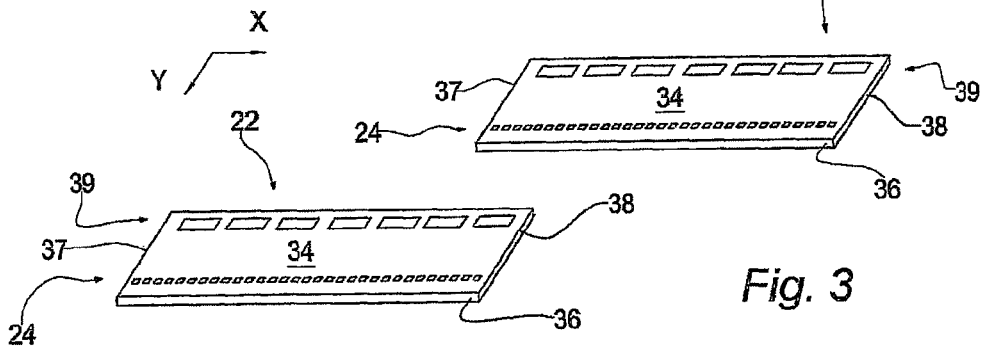
FIG. 3 represents two components of the device of the invention.
Figure 4:
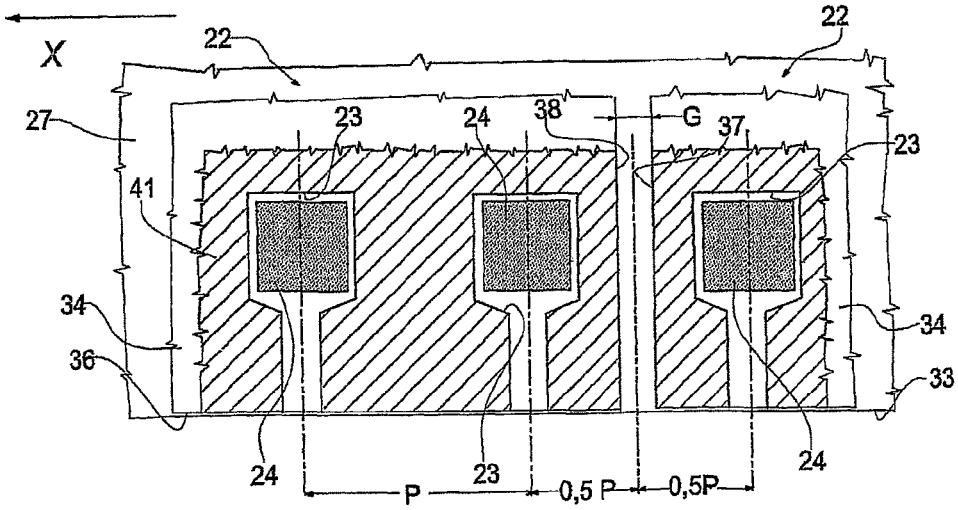
FIG. 4 is an enlarged scale, layout diagram of the components of FIG. 3.

The head 21 comprises a plurality of ejection modules 22, arranged in a row, aligned among one another and parallel to the "X" axis (FIG. 3). Each module 22 is provided with respective ejection chambers 23 (FIGS. 4, 5 and 6) suitable for containing ink and with associated relative heating elements or resistors 24, with a "topshooter" type architecture for control of the function of ejecting ink on a sheet 26.

In accordance with the invention, the head 21 (FIGS. 1, 2, 4 and 6) comprises a support including a base plate 27 for the modules 22 and hydraulic tight means between the modules 22 and the support. The tight means encloses a lamina which extends parallel to the "X" axis in the embodiment described herein. The ejection nozzles indicated with 32 are obtained in the same lamina, defined as nozzle plate 28, and are disposed along a line which extends parallel to the "X" axis. A chip driver 29, for selection and driving of the modules 22, and an auxiliary tank 31 for the ink are also included.

The support, the nozzle plate 28 and the tank 31 are common for all the modules 22 of the row and extend parallel to the "X" axis. The plate 27 is of rigid and isolating material and acts as a support for the modules 22.

The plate 27 includes a feeding duct for the ink defined by a slot-shaped aperture 33 which passes through the thickness of the plate itself and is connected to the tank 31. On the plate, behind the row of modules 22 in the direction of the "Y" axis, is mounted the chip driver 29. According to known techniques, the selection and driving functions may, alternatively, be handled by integrated circuits in the individual modules 22.

The ejection modules 22 are mounted side by side on the plate 27, with the chambers 23 in hydraulic, tight connection with the aperture 33. The plate 28 is mounted on the modules 22 and constitutes a hydraulically tight upper cover for them, for the chambers 23 and in which the nozzles 32 are in hydraulic, tight connection with corresponding chambers 23 of the modules 22.

The idea of the solution according to this invention is that of constructing the printing device 20 using a head 21 with a plurality of ejection modules 22, having sides 37 and 38 of reduced dimensions (along the Y axis), that are simple to produce and that are assembled together at the end of their respective machining processes.

The plate 27 extends substantially for the length of the printing line of the sheet 26 and the slot-shaped aperture 33 extends along the plate, also for the length of the printing line along the "X" axis, adjacent to a front thereof.

Figure 5:
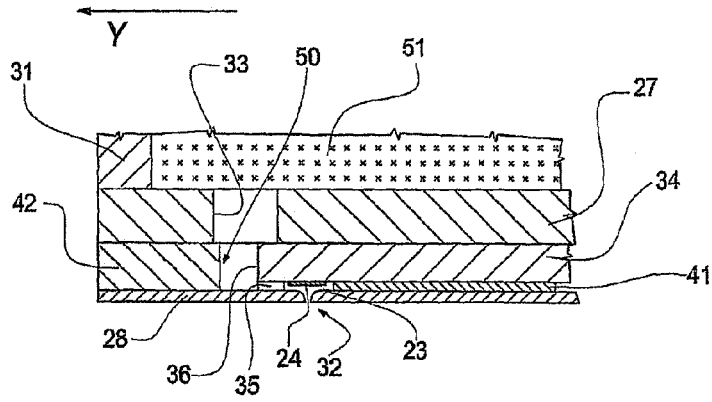
FIG. 5 shows details, in enlarged scale, of the section of FIG. 3.
Figure 6:
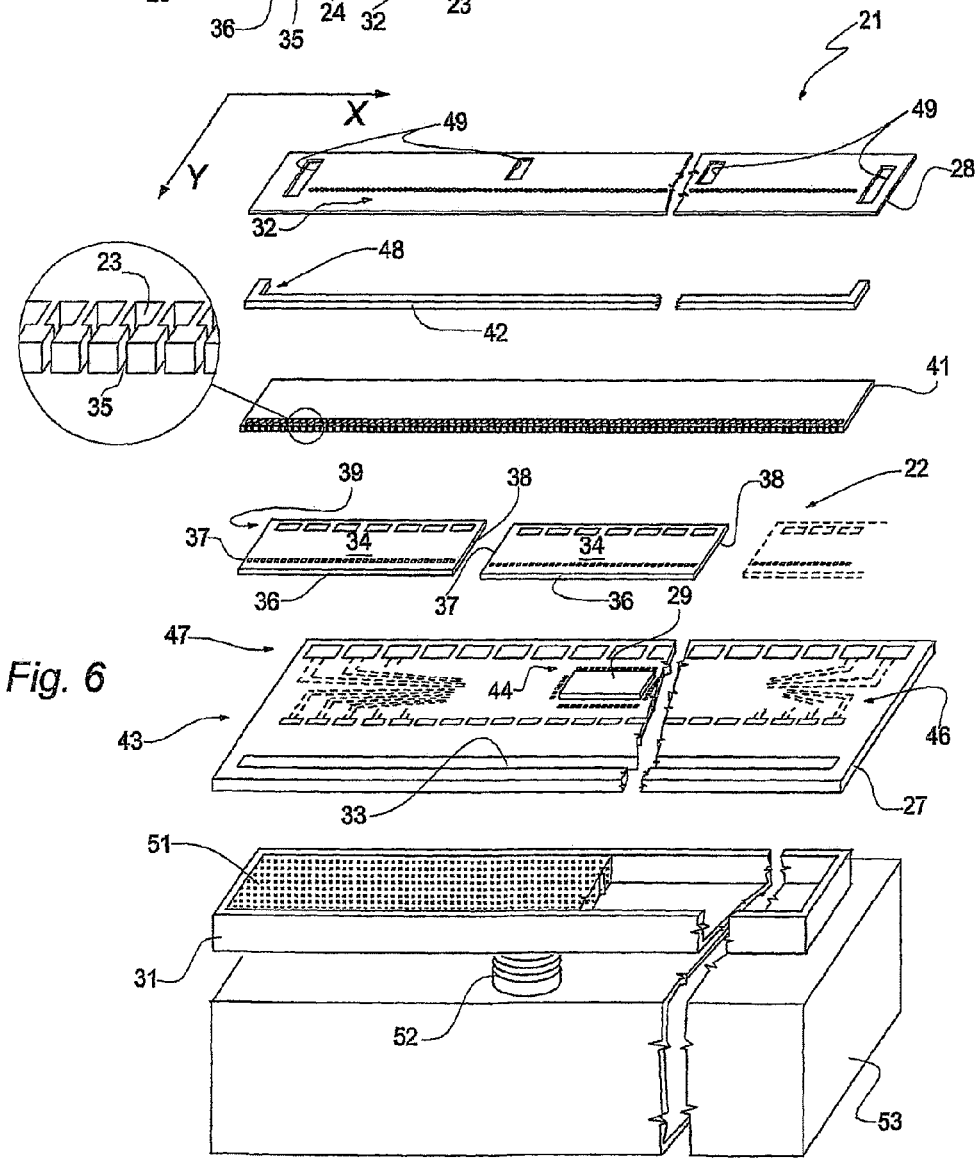
FIG. 6 shows an expanded view of the printing device of FIG. 1.

Each module 22 consists of a rectangular shaped die 34 of crystalline silicon, with a front of greater length 36 and sides 37 and 38. Using known processes, the active components constituting the selections circuits are made on the die 34. Made next are the layers relative to the heating elements or resistors 24, the relative interconnections, not shown in any figures, and I/O pads 39 and a photosensitive resin film 41 in which the ink ejection chambers 23, aligned with the corresponding heating elements or resistors 24, and the feeding ducts 35 are made (FIGS. 5 and 6).

The various ejection modules 22, for the length associated with the line of print, are mounted on the base plate 27 by gluing and pressing. In particular, the modules are disposed with the fronts of greater length 36 aligned among each other and parallel to the "X" axis (FIG. 3). Also glued on to plate 27 adjacent to the edges of the modules 22 is a counterpart, or frame 42, of thickness equal to that of the modules 22.

The head 21 is completed with the application, above the frame 42 and the modules 22, of the plate 28, the ejection nozzles 32 of which are exactly facing the ejection chambers 23 and the respective resistors 24, in such a way that the ink droplets are ejected on the sheet 26 (FIG. 2) in a direction perpendicular to the plane of the nozzle plate 28.

The ejection modules 22 have, for example, a width of 1.5-2.5 mm and a length of 8.4 mm (⅓") or 12.4 mm (½") or greater, and may be made from a wafer of crystalline silicon, not shown in any of the drawings, of thickness between 400 and 600 μm. In detail, from a disk of 6", approximately 700 modules may be made, net of any production rejects. In the die 34 the chambers 23 and the resistors 24 (FIGS. 3, 4 and 5) are arranged parallel to the front 36 adjacent to the edge, the I pads/O 39 along the opposite front and the active components in the central part.

The logic circuits for selection, the resistors 24, the ejection chambers, the I/O pads, the internal interconnections and those for the ink may be obtained, following construction processes known in the art, as described for instance in Italian patent No. 1.234.800, or in Italian patent application No. TO2001A001019 filed by the applicant, which are cited for reference.

On each module 22 (FIG. 4), the chambers 23 and the resistors 24 have pitch "P" equal to the pitch of the nozzles 32, whereas the distances between the sides 37 and 38 and the axes of the terminal chambers 23 are slightly less than "0.5 P", so as to allow, during assembly on the plate 27, a space "G" to be left between the sides 37 and 38 of two adjacent modules 22, ensuring alignment and constancy of the pitch "P" between the chambers of the two modules.

Following formation of the selecting and actuating circuits in the silicon disc, deposition of the layer of polymer 41 in which the chambers 23 and feeding channels 35 are made, and the usual sight and electrical test inspections, the modules 22 are separated by cutting of the disc, according to a rectangular grid of dimensions conforming to the dimensions of the individual modules.

The base plate 27 (FIG. 5) is substantially rectangular, delimited by opposite, flat and parallel surfaces. The plate 27 may be cut by a rigid, electrically isolating, chemically inert sheet, with coefficient of thermal expansion close to that of the crystalline silicon, such as aluminium oxide or borosilicate glass.

By way of example, the material may be silicon of the type known commercially as "reworked", without any special electrical or mechanical characteristics, however it is also possible to use a thermally stabilized, ceramic-coated, reinforced plastic metal (PCB).

The slot-shaped aperture 33 may be obtained without any restrictions on precision as it has no delicate components. It can be made with any one of the methods known in the sector art, such as sand blasting, laser beam, vacuum plasma, chemical etching, etc. In the case of aluminium oxide or ceramic, the slot can be obtained by moulding before firing.

Metallic layers are made on the base plate 27 in which to create soldering pads 43 and 44, interconnection tracks 46 (depicted merely by way of example) and I/O pads 47. The pads 43 and 44 concern the connections to the I/O pads 39 of the modules 22 and the soldering with the terminals of the chip driver 29, and the I/O pads 47 are provided for connection of the device 20 with cables of the printer, not shown in any of the figures.

The pads 43, 44 and 47 and the interconnection tracks 46 may be of thick film or thin film if the support is ceramic or of gold plated copper in the case of a plastic support (PCB).

The counterpart 42 comprises a substantially rectangular shaped resin frame of the same thickness as the module 22 and having a central aperture 48, also rectangular shape. The aperture 48 is complementary to the overall dimension of all the ejection modules 22 parallel to the fronts 36 and such as to partially or totally border the side 37 of the first module and the side 38 of the last module 22.

Following assembly, the counterpart or frame 42 is at a distance from the fronts 36 in such a way as to form a passage for the ink 50 communicating with the slot 33 and, through the feeding channels 35 made with the photosensitive film 41, with the ejection chambers 23. The thickness of the counterpart 42, the same as that of the modules 22, ensures that the respective upper surfaces form a flat surface, thus facilitating tight gluing of the nozzle plate 28 (FIG. 5).

The nozzle plate 28 is made of Kapton™ and, as well as the nozzles 32, also includes slots 49 which, during the assembly stage, are in correspondence with junctions in the sides of the modules 22 and in the heads, and are filled with resin to obtain a hydraulic seal. The plate 28 can be made from a tape etched by laser, leaving support appendages. Alternatively, the plate 28 may be obtained by electroforming of a thin metallic sheet of gold-plated nickel.

The auxiliary tank 31 is defined by a hollow body of parallelepiped shape, of the same length as the aperture 33 and arranged on the surface of the plate 27 opposite that on which the modules 22 are mounted. The tank 31, internally, has a well-known sponge type filling 51, is in hydraulic, tight connection with the aperture 33 and can be filled with ink for testing functionality of the head 21.

The device 20 also comprises, associated with the head 20, a main ink cartridge 53, removable type, suitable for connection with the tank 31 through an elastic joint filter 52. The joint filter 52 acts as a mechanical decoupling between head 21 and cartridge 53 and tight, filtering coupling in relation to the cartridge 53.

Assembly of the device 20, for the head 21 entails a step in which the modules 22 are mounted on the base plate 27. More specifically, the modules are positioned respecting the alignment, shown in FIGS. 4 and 5, of the edges 36 facing the slot-shaped aperture 33 and stuck hydraulically tight by means of a polymerizable adhesive.

The counterpart or frame 42 is positioned and then stuck on the plate 27, with the top part coplanar with the upper surface of the modules 22 defining, together with the edges 36, the passage for the ink 50 facing the slot-shaped aperture 33.

An adhesive is then placed on the counterpart 42, and the plate 28 is positioned on the modules 22 and on the counterpart 42, with the nozzles 32 facing the chambers 23. Next pressing and heating are performed to polymerize the adhesive of the counterpart 42 and the film 41 of the modules 22, gluing the plate 28 tight to the modules 22 and to the counterpart 42, thereby forming the upper closing surface of the ejection chambers 23 and of the ink passage 50.

The slots 49 are then filled with resin in correspondence with the spaces between the various components, guaranteeing that they are mechanically and hydraulically sealed. In addition, the auxiliary tank 31 is fixed tight on the plate 27, in connection with the slot-shaped aperture 33.

The preparation of the base plate 27 is completed with electrical connection (wire bonding) of the I/O pads 39 of the modules 22 with the soldering pads 43 of the base plate 27 and with the soldering of the chip driver 29 to the pads 44.

A flat cable, not shown in any of the figures, is connected to the device 20, produced as described, by soldering of its ends to the I/O pads 47.

In the printer in operating conditions, the elastic joint filter 52 and the flat cable allow the whole consisting of the modules 22 and the base plate 27 to move transversally with respect to the sheet 26, while keeping the cartridge 53 still.

In the same way as described in patent application no. TO2001A000707, the device 20 of the invention can be used in a printer in which the transversal oscillating movement is impressed on the sheet, while the relative head remains still.

The cartridge 53 may be replaced periodically with arrangements similar to those adopted for replacement of the ink cartridges, provided with refill capability, in serial printing devices.

Figure 7:
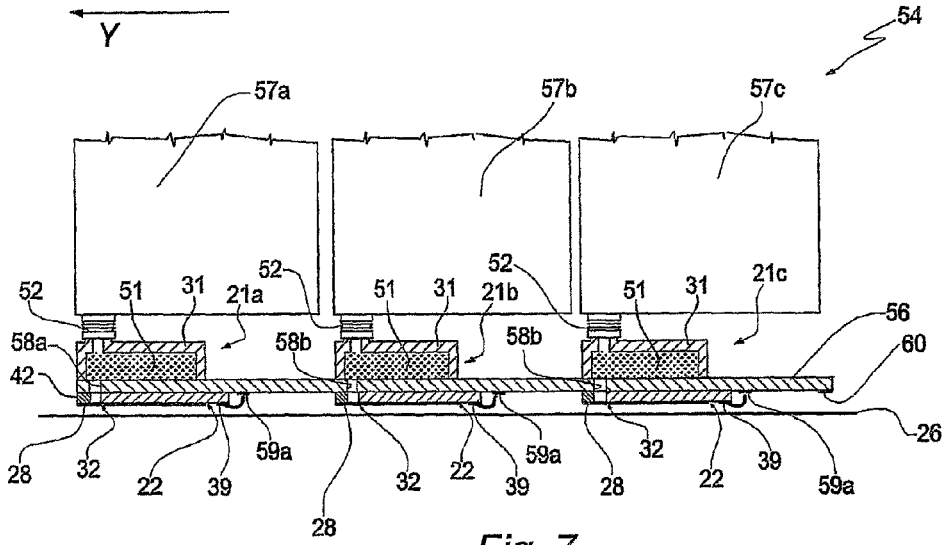
FIG. 7 depicts a colour printing group operating in parallel or serial-parallel in accordance with the invention.

The process of preparing the device 20 described above is suitable, without any particular changes, for producing parallel or serial-parallel type colour printing groups. Shown in FIG. 7 is a colour printing group, designated with the numeral 54, in which three heads 21*a*, 21*b* and 21*c* similar to the head 21 of the device 20 are assembled on a single plate 56, each with a row of modules 22, relative counterpart 42 and the nozzle plate 28, for three relative ink cartridges 57*a*, 57*b* and 57*c* with the fundamental colours and through three auxiliary tanks 31.

The modules 22 of each row are aligned parallel to the "X" axis and the three heads are arranged one behind the other along the "Y" axis. The modules 22 are active type with integrated selection circuits, to minimize the number of interconnection tracks.

The plate 56 is of the same length on the "X" axis as the plate 27 of FIG. 6 and has three slot-shaped apertures 58*a*, 58*b* and 58*c*, each identical to the aperture 33 and having the purpose of feeding the three rows of modules 22 with the ink of the cartridges. The width of the group 54 on the "X" axis and the overall height are substantially determined by the dimensions and therefore by the effective capacity of the cartridges 57*a*, 57*b* and 57*c*.

Figure 8:
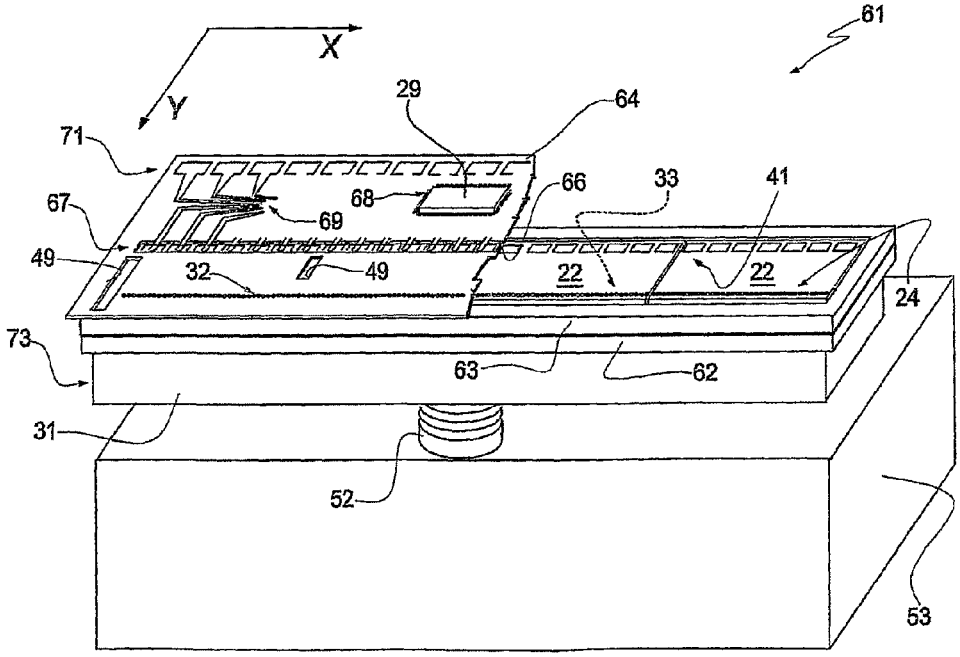
FIG. 8 is a schematic view of a variant of the printing device of the invention.
Figure 9:
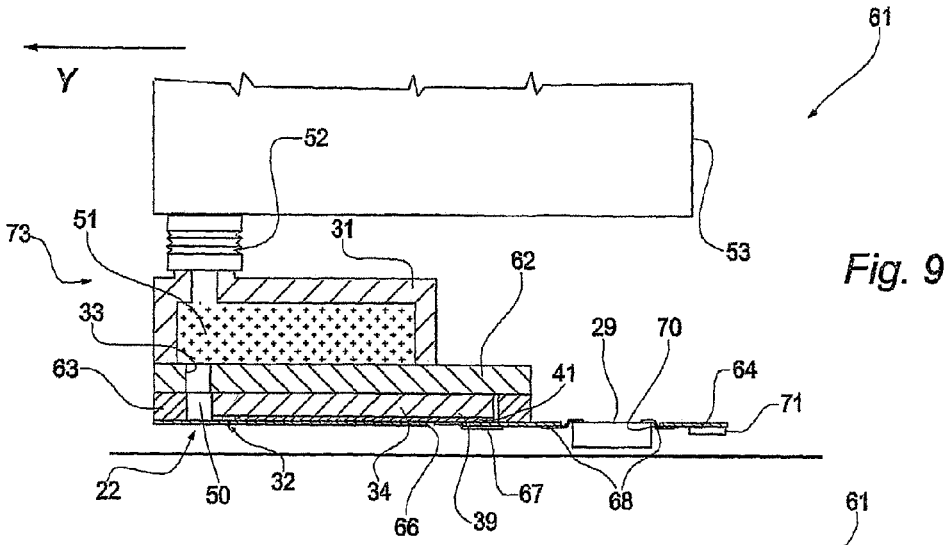
FIG. 9 shows a schematical section of the device of FIG. 8.
Figure 10:
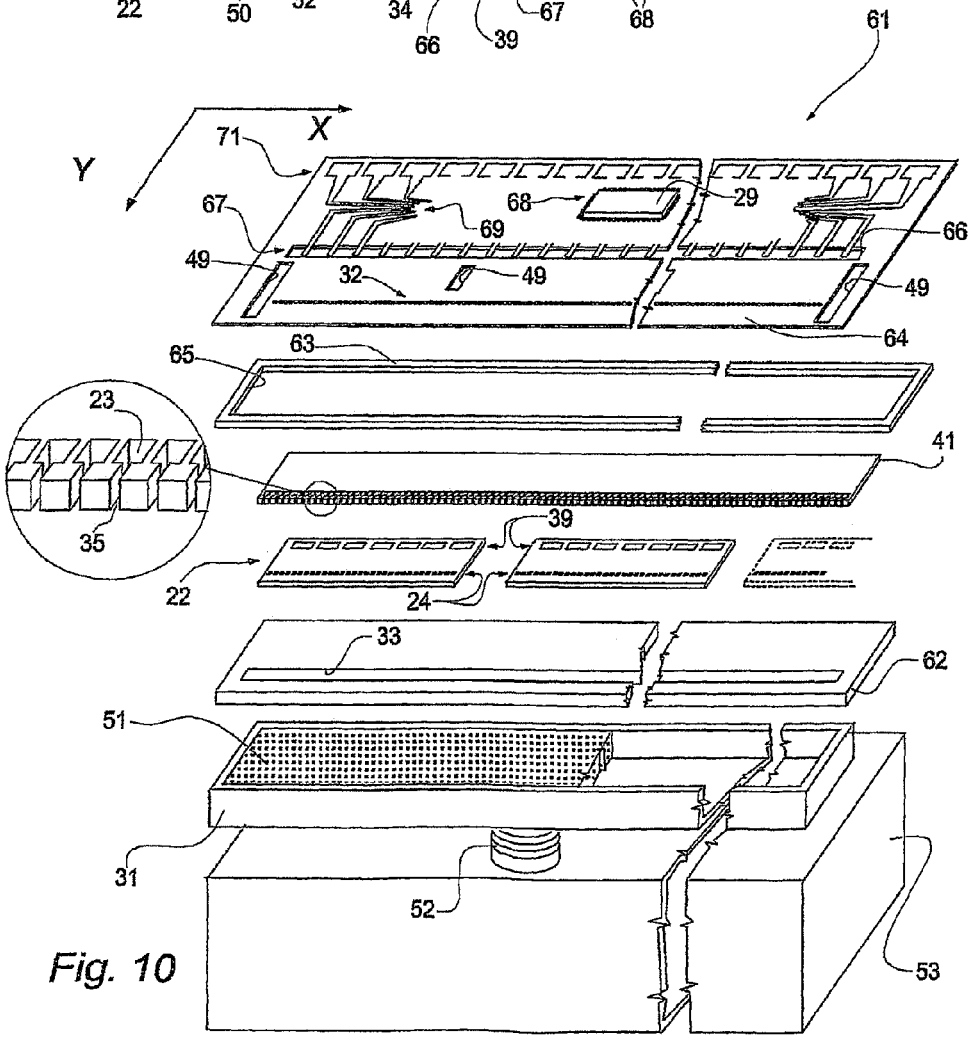
FIG. 10 shows an expanded view of the variant of FIG. 8.

Represented upside-down in FIGS. 8, 9 and 10, designated with the numeral 61, is a variant of the printing device according to the invention, also with a serial-parallel type head, here indicated with the numeral 73 and in which the same parts have the same numbering arrangements as before.

The head 73 also has the ejection modules 22 aligned with the row of nozzles 32 arranged in a single line parallel to the line of printing, and therefore the "X" axis. These modules are fed from the auxiliary tank 31 and are driven by the chip driver 29.

In this variant, the head 73, on the other hand, has a base plate, indicated with 62 for assembly of the modules 22, a frame 63 and a nozzle plate 64.

The plate 62 defines the support element for the modules 22 and the lamina 64 defines the row of ejection nozzles 32. The plate 62 is made of the same material as the plate 27 of FIG. 6 and includes the slot-shaped aperture 33 connected to the tank 31, but is without the metallic conducting layers. The ejection modules 22 are mounted on the plate 62 and the frame 63 has an aperture 65 that completely surrounds the modules 22.

The nozzle plate 64 is mounted on the modules 22 and on the frame 63 and its nozzles 32 are hydraulically connected to the chambers 23 of the modules 22. The plate 64 extends width-wise along the "Y" axis beyond the I/O pads 39 and is provided with a slot 66 above the pads 39, an aperture 70 for accommodating the chip driver 29 and soldering tabs 67 and 68, respectively for the connections to the I/O pads 39 and for the soldering with the terminals of the chip driver 29, interconnection tracks 69 and I/O pads 71.

The head 73 is assembled in the same way as the head 20 as regards the gluing of the various components. In this case however, the electrical connections between the pads of the modules 22 and the terminals of the chip driver 29 with the I/O pads 71 are made by direct thermocompression soldering on the tabs 67 and 68, through the slot 66 and the aperture 70.

Naturally, the device 61 may also be used for forming a colour printing group (not shown in any of the figures), by assembling on a single plate 62 three heads of the device 61, each with a row of modules 22 for three relative ink cartridges 57*a*, 57*b* and 57*c* with the fundamental colours through three auxiliary tanks 31 and, for instance, with a single nozzle plate 64.

The devices 20 or 61 may be used to produce printers of reduced dimensions and low cost for the printing of compact size media, such as payment slips, labels and strips 1" wide, using two modules 22 of ½" or three modules of ⅓" or for printers of 2" or 4", with four or eight modules of ½" for use in conjunction with digital cameras or in relative, compact accessories or for measuring instruments.

Figure 11:
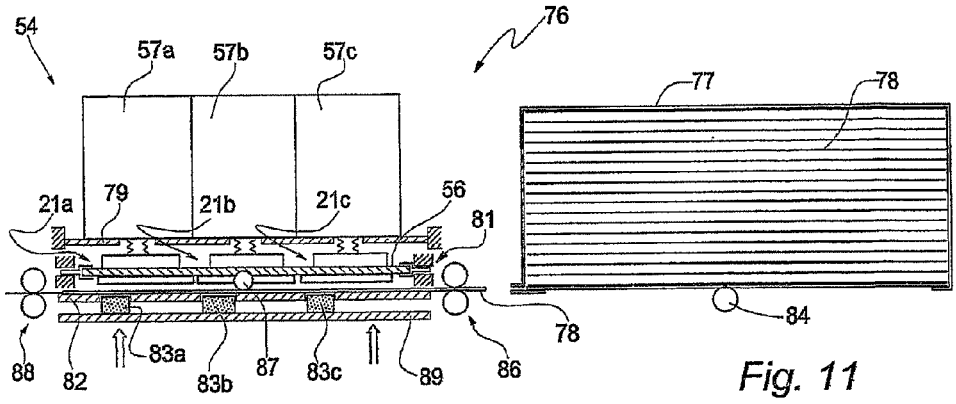
FIG. 11 represents a schematical view of a printer that uses a printing device according to the invention.

FIG. 11 shows a printer 76 which uses the colour printing group 54 with the three heads 21*a*, 21*b* and 21*c*, in association with a bin 77 for a series of paper cards 78.

The printer 76 comprises a support plate 79 for the three cartridges 57*a*, 57*b* and 57*c*. Guiding elements 81 are provided for the oscillating movement of the plate 56, a support frame 82 for the paper cards 78 while they are being printed and sealing plugs 83*a*, 83*b* and 83*c* for the heads 21*a*, 21*b* and 21*c*.

The paper card 78 extraction and feeding movements are performed by way of a skimming roller 84, a couple of feeding rollers 86, two intermediate rollers 87 and two pairs of terminal rollers 88.

The paper cards 78 are overlaid in the bin 77, with the bottom-most paper card resting on the skimming roller 84 over its full width.

The roller 84 is suitable for skimming the paper cards 78, bringing them between the feeding rollers 86, co-planar with the frame 82. In the feeding movement, the rollers 86 are suitable for engaging the paper card 78 over its entire width, whereas the rollers 87 and 88 can mesh with the edges of the paper card, according to a known technique.

The plugs 83*a*, 83*b* are 83*c* are partially accommodated, with abundant clearance in correspondence with apertures in the frame 82 and are supported by a plate 89 arranged below the frame 82 and capable of vertical movement.

When printing is finished, the plate 89 is lifted up, bringing the plugs 83*a*, 83*b* and 83*c* to seal the nozzles of the heads 21*a*, 21*b* and 21*c*.

Movement of the heads 21 or 73 of the devices 21 or 54 or 61 and driving of the nozzles can be in combination with a continuous movement of the print medium, of the type described in patent application no. TO2001A000707 filed by the applicant.

In particular, a printer that uses a colour printing group 54 with three heads 21*a*, 21*b*, 21*c* of the device 54 comprises a control unit which controls, through the chip driver 29, the driving of the nozzles and provides for synchronization of the relative commands with the movements of the medium and with the oscillating movement of the carriage.

A low oscillation frequency of the heads is selected, between 5 and 40 Hz and preferably less than 20 Hz. In this way, as well as a reduction in the noise emitted by the moving parts, the printing time can be considered instantaneous with respect to the displacements under way.

Figure 12B:
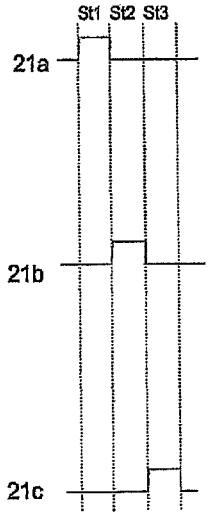
FIGS. 12*a*, 12*b* and 12*c* represent wiring and operating diagrams of the printing device according to the invention.
Figure 12A:
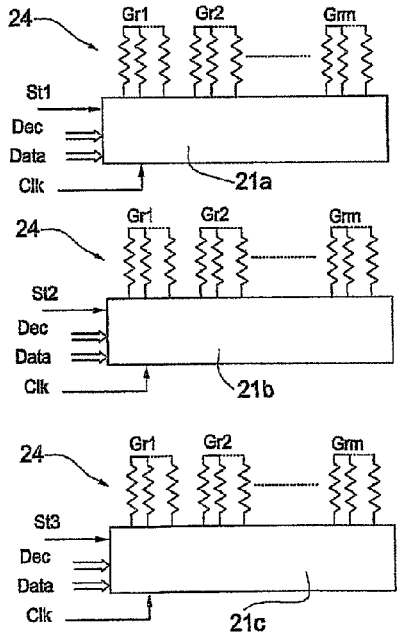

Just as an example, the device 54 provides specific signals St1, St2 and St3 for the modules 22 of the heads 21*a*, 21*b*, 21*c* (FIG. 12*a*) and, in common with the modules, a data channel Dat, a decoder channel Dec and a synchronization line Clk. The single modules 22 may be selected through the signals St1, St2 and St3 whereas the resistors 24 of the modules selected can be activated by the selecting circuits through the Dat and Dec channels.

Figure 12C:
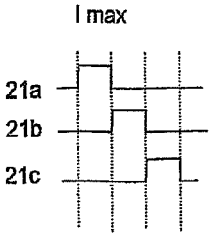

Advantageously, the resistors 24 (FIGS. 12*a*, 12*b* and 12*c*) are activated in sequential groups Gr1, Gr2, Grm and the time periods associated with the signals St1, St2, St3 are differentiated in order to minimize the peak currents Imax and permit the use of an autonomous battery-supplied power supply.

In an example of application, heads 21*a*, 21*b*, 21*c* are used with 640 dots in a pitch of 1/300" and in which the relative resistors are driven in 16 blocks of 40. With a head oscillation period of 33 msec (30 Hz), 8 lines of dots with pitch 1/600 can be printed. As the scan time of a group of 16 resistors is 2 μs, in order to scan a mini-line, it takes 80 μs=0.08 ms, and 0.24 ms for selection of the 1920 nozzles of the three basic colours.

With peak absorption of each resistor of 0.07 A, the peak current needed to simultaneously energize 16 resistors of a group is approx. 1.12 A.

In the example under consideration, the head oscillating movement does not in any substantial way worsen the printer's working characteristics. In fact, for the 30 Hz oscillation frequency, a period of approx. 4 ms per line is available and the time needed to print a line is therefore more than 16 times less the time necessary for the sheet to travel the corresponding distance.

The printing time can therefore be considered instantaneous with respect to the continuous movement of the print medium, and there are no drawbacks in deposition of the ink on the sheet.

The nozzle resolution of 1/300" allows practicable module 22 machining and positioning tolerances. In the case of parallel printing without oscillating head movement, the printing resolution will be the same as that of the nozzles.

For a serial-parallel printing mode, the overall resolution may be significantly greater than that of the nozzles, depending on the movement of the device 20, 54, 61 with respect to the sheet, as described in the patent application no. TO2001A000707 cited above, but with the simplification that, in this case, the nozzles are all arranged in a single line.

To produce low cost printers, modules with nozzles of pitch less than 1/300" may be used, considerably increasing amplitude of the oscillating movement.

Moreover, it is also possible to do without the terminal chambers of the modules 22 and the relative nozzles, thereby further simplifying the precision of assembly, by printing the dots relative to these missing nozzles following the printing method of this application.

From what has been described, it is clear that the printing devices according to the invention offer numerous advantages with respect to those of the prior art. In fact, production of these devices is simpler and more reliable because, as the feeding slots are separate from the modules, they do not have the restrictions regarding precision and high quality finishing required by the traditional manufacturing techniques. The new devices are also cheaper, because the active modules do not have slots, which cause low production yields, they are not fragile, they allow a greater number of chips to be had on each wafer and therefore a lower cost, and can be built in compact dimensions.

Naturally, without prejudice to the principle of this invention, the embodiments and the construction details of the printing device with ink jet head may be abundantly varied with respect to what has been described and illustrated, purely by way of non-restricting example, without departing from the scope of the invention.

The invention claimed is:

1. Ink jet printing device with a head or with various heads of the parallel type, comprising:

a plurality of ejection modules, each comprising a plurality of ejection chambers adapted to contain and eject ink, associated relative heating elements adapted to command ejection of the ink onto a print medium, the print medium capable of a continuous feeding displacement; and one or more cartridges of ink for the head or for the heads;

wherein said modules are adapted for alternating motion in relation to the displacement of the print medium to parallel print in a single pass at a printing resolution greater than the physical resolution of the pitch between the nozzles, and said cartridge or said cartridges of ink are removably connected to said modules through one or more elastic joints to decouple the modules and said cartridge.

2. Ink jet printing device according to claim 1, wherein timing of said alternating motion is controlled so as the alternating motion timing needed to print a line is lesser than the displacement timing of the print medium.

3. Ink jet printing device according to claim 1, wherein said plurality of ejection modules are mounted side by side along a same direction.

4. Ink jet printing device according to claim 3, wherein said chambers of said plurality of ejection modules are arranged in a single line with a constant pitch.

5. Ink jet printing device according to claim 3, wherein said cartridge or said cartridges of ink are hydraulically and removably connected to said modules.

6. Printer comprising an ink jet printing device according to claim 1, wherein said alternating motion is synchronous with the continuous feeding displacement of said print medium.

7. Ink jet printing device with a head or with various heads of the parallel type, comprising:

a plurality of ejection modules arranged with a pitch corresponding to a physical resolution, each of said ejection modules with ejection chambers adapted to contain and eject ink and having associated relative heating elements for commanding ejection of the ink on a print medium; and one or more cartridges of ink for the head or for the heads;

wherein said print medium is adapted for alternating motion in relation to said modules for a parallel printing in a single pass with printing resolution greater than the physical resolution of the pitch.

8. Printer comprising an ink jet printing device according to claim 7.

9. Printer according to claim 8, wherein said cartridge or said cartridges of ink are hydraulically and removably connected to said modules.

10. Ink jet printing device with a head or with various heads of the parallel type, comprising:

a plurality of ejection modules, each comprising:

a plurality of nozzles spaced apart by a pitch defining a physical resolution, corresponding ejection chambers adapted to contain and eject ink, and heating elements associated with the ejection chambers, the heating elements adapted to eject ink onto a print medium capable of a continuous feeding displacement;

one or more cartridges of ink for the head or for the heads; and a control unit adapted to impart alternating motion of said ejection modules in relation to the displacement of the print medium to parallel print in a single pass at a printing resolution greater than the physical resolution of the pitch between the nozzles.

11. The ink jet printing device of claim 10, wherein the control unit is adapted to time the alternating motion of said ejection modules so the duration of the alternating motion needed to print a line is less than the duration of displacement of the print head with respect to the print medium needed to print a line.

* * * * *